US009458634B2

(12) United States Patent
Derelov

(10) Patent No.: US 9,458,634 B2
(45) Date of Patent: Oct. 4, 2016

(54) BUILDING PANEL WITH A MECHANICAL LOCKING SYSTEM

(71) Applicant: VALINGE INNOVATION AB, Viken (SE)

(72) Inventor: Peter Derelov, Helsingborg (SE)

(73) Assignee: VALINGE INNOVATION AB, Viken (SE)

( * ) Notice: Subject to any disclaimer, the term of this patent is extended or adjusted under 35 U.S.C. 154(b) by 0 days.

(21) Appl. No.: 14/709,913

(22) Filed: May 12, 2015

(65) Prior Publication Data

US 2015/0330088 A1 Nov. 19, 2015

(30) Foreign Application Priority Data

May 14, 2014 (SE) ..... 1450568

(51) Int. Cl.

| | |
|---|---|
| ***E04F 15/02*** | (2006.01) |
| ***E04B 5/00*** | (2006.01) |
| ***E04F 13/08*** | (2006.01) |

(52) U.S. Cl.

CPC ..... *E04F 15/02038* (2013.01); *E04F 13/0894* (2013.01); *E04F 15/02022* (2013.01); *E04F 2201/0146* (2013.01); *E04F 2201/023* (2013.01); *E04F 2201/043* (2013.01); *E04F 2201/044* (2013.01); *E04F 2201/0523* (2013.01); *E04F 2201/0535* (2013.01); *E04F 2201/0547* (2013.01); *E04F 2201/0552* (2013.01)

(58) Field of Classification Search

None

See application file for complete search history.

(56) References Cited

U.S. PATENT DOCUMENTS

| | | | |
|---|---|---|---|
| 87,853 | A | 3/1869 | Kappes |
| 108,068 | A | 10/1870 | Utley |
| 124,228 | A | 3/1872 | Stuart |
| 213,740 | A | 4/1879 | Conner |
| 274,354 | A | 3/1883 | McCarthy et al. |
| 316,176 | A | 4/1885 | Ransom |
| 634,581 | A | 10/1899 | Miller |
| 861,911 | A | 7/1907 | Stewart |
| 1,194,636 | A | 8/1916 | Joy |
| 1,723,306 | A | 8/1929 | Sipe |
| 1,743,492 | A | 1/1930 | Sipe |
| 1,809,393 | A | 6/1931 | Rockwell |

(Continued)

FOREIGN PATENT DOCUMENTS

| | | | |
|---|---|---|---|
| CA | 2456513 | A1 | 2/2003 |
| CN | 201588375 | U | 9/2010 |

(Continued)

OTHER PUBLICATIONS

U.S. Appl. No. 14/683,340, Pervan.

(Continued)

*Primary Examiner* — Elizabeth A Quast
*Assistant Examiner* — Kyle Walraed-Sullivan
(74) *Attorney, Agent, or Firm* — Buchanan Ingersoll & Rooney P.C.

(57) ABSTRACT

A set of essentially identical panels (1, 1'), such as building panels, provided with a mechanical locking system including a displaceable tongue (30), which is arranged in a displacement groove at a first edge of a first panel (1). A second panel is provided with a tongue groove at a second edge. The displaceable tongue is configured to cooperate with the tongue groove (20) for locking together the first and the second edge. The displaceable tongue has a spring constant that varies along the length of the tongue.

19 Claims, 6 Drawing Sheets

(56) References Cited

U.S. PATENT DOCUMENTS 1,902,716 A 3/1933 Newton
2,026,511 A 12/1935 Storm
2,204,675 A 6/1940 Grunert
2,266,464 A 12/1941 Kraft
2,277,758 A 3/1942 Hawkins
2,430,200 A 11/1947 Wilson
2,596,280 A 5/1952 Nystrom
2,732,706 A 1/1956 Friedman
2,740,167 A 4/1956 Rowley
2,858,584 A 11/1958 Gaines
2,863,185 A 12/1958 Riedi
2,865,058 A 12/1958 Andersson
2,889,016 A 6/1959 Warren
3,023,681 A 3/1962 Worson
3,077,703 A 2/1963 Bergstrom
3,099,110 A 7/1963 Spaight
3,147,522 A 9/1964 Schumm
3,271,787 A 9/1966 Clary
3,325,585 A 6/1967 Brenneman
3,331,180 A 7/1967 Vissing et al.
3,378,958 A 4/1968 Parks et al.
3,396,640 A 8/1968 Fujihara
3,512,324 A 5/1970 Reed
3,517,927 A 6/1970 Kennel
3,526,071 A 9/1970 Watanabe
3,535,844 A 10/1970 Glaros
3,572,224 A 3/1971 Perry
3,579,941 A 5/1971 Tibbals
3,720,027 A 3/1973 Christensen
3,722,379 A 3/1973 Koester
3,731,445 A 5/1973 Hoffmann et al.
3,742,669 A 7/1973 Mansfeld
3,760,547 A 9/1973 Brenneman
3,760,548 A 9/1973 Sauer et al.
3,778,954 A 12/1973 Meserole
3,849,235 A 11/1974 Gwynne
3,919,820 A 11/1975 Green
3,950,915 A 4/1976 Cole
3,994,609 A 11/1976 Puccio
4,007,994 A 2/1977 Brown
4,030,852 A 6/1977 Hein
4,037,377 A 7/1977 Howell et al.
4,041,665 A 8/1977 de Munck
4,064,571 A 12/1977 Phipps
4,080,086 A 3/1978 Watson
4,082,129 A 4/1978 Morelock
4,100,710 A 7/1978 Kowallik
4,104,840 A 8/1978 Heintz et al.
4,107,892 A 8/1978 Bellem
4,113,399 A 9/1978 Hansen, Sr. et al.
4,169,688 A 10/1979 Toshio
RE30,154 E 11/1979 Jarvis
4,196,554 A 4/1980 Anderson
4,227,430 A 10/1980 Janssen et al.
4,299,070 A 11/1981 Oltmanns
4,304,083 A 12/1981 Anderson
4,426,820 A 1/1984 Terbrack
4,447,172 A 5/1984 Galbreath
4,512,131 A 4/1985 Laramore
4,599,841 A 7/1986 Haid
4,648,165 A 3/1987 Whitehorne
4,819,932 A 4/1989 Trotter, Jr.
5,007,222 A 4/1991 Raymond
5,026,112 A 6/1991 Rice
5,071,282 A 12/1991 Brown
5,135,597 A 8/1992 Barker
5,148,850 A 9/1992 Urbanick
5,173,012 A 12/1992 Ortwein et al.
5,182,892 A 2/1993 Chase
5,247,773 A 9/1993 Weir
5,272,850 A 12/1993 Mysliwiec et al.
5,274,979 A 1/1994 Tsai
5,295,341 A 3/1994 Kajiwara
5,344,700 A 9/1994 McGath et al.
5,348,778 A 9/1994 Knipp et al.
5,373,674 A 12/1994 Winter, IV
5,465,546 A 11/1995 Buse
5,485,702 A 1/1996 Sholton
5,502,939 A 4/1996 Zadok et al.
5,548,937 A 8/1996 Shimonohara
5,577,357 A 11/1996 Civelli
5,598,682 A 2/1997 Haughian
5,618,602 A 4/1997 Nelson
5,634,309 A 6/1997 Polen
5,658,086 A 8/1997 Brokaw et al.
5,694,730 A 12/1997 Del Rincon et al.
5,755,068 A 5/1998 Ormiston
5,860,267 A 1/1999 Pervan
5,899,038 A 5/1999 Stroppiana
5,950,389 A 9/1999 Porter
5,970,675 A 10/1999 Schray
6,006,486 A 12/1999 Moriau
6,029,416 A 2/2000 Andersson
6,052,960 A 4/2000 Yonemura
6,065,262 A 5/2000 Motta
6,173,548 B1 1/2001 Hamar et al.
6,182,410 B1 2/2001 Pervan
6,203,653 B1 3/2001 Seidner
6,254,301 B1 7/2001 Hatch
6,295,779 B1 10/2001 Canfield
6,314,701 B1 11/2001 Meyerson
6,332,733 B1 12/2001 Hamberger
6,339,908 B1 1/2002 Chuang
6,345,481 B1 2/2002 Nelson
6,358,352 B1 3/2002 Schmidt
6,363,677 B1 4/2002 Chen et al.
6,385,936 B1 5/2002 Schneider
6,418,683 B1 7/2002 Martensson et al.
6,446,413 B1 9/2002 Gruber
6,449,918 B1 9/2002 Nelson
6,450,235 B1 9/2002 Lee
6,490,836 B1 12/2002 Moriau et al.
6,505,452 B1 1/2003 Hannig
6,546,691 B2 4/2003 Leopolder
6,553,724 B1 4/2003 Bigler
6,576,079 B1 6/2003 Kai
6,584,747 B2 7/2003 Kettler et al.
6,591,568 B1 7/2003 Pålsson
6,601,359 B2 8/2003 Olofsson
6,617,009 B1 9/2003 Chen et al.
6,647,689 B2 11/2003 Pletzer et al.
6,647,690 B1 11/2003 Martensson
6,651,400 B1 11/2003 Murphy
6,670,019 B2 12/2003 Andersson
6,681,820 B2 1/2004 Olofsson
6,685,391 B1 2/2004 Gideon
6,729,091 B1 * 5/2004 Martensson ..... 52/391
6,763,643 B1 7/2004 Martensson
6,766,622 B1 7/2004 Thiers
6,769,219 B2 8/2004 Schwitte et al.
6,769,835 B2 8/2004 Stridsman
6,802,166 B1 10/2004 Durnberger
6,804,926 B1 10/2004 Eisermann
6,808,777 B2 10/2004 Andersson et al.
6,854,235 B2 2/2005 Martensson
6,862,857 B2 3/2005 Tychsen
6,865,855 B2 3/2005 Knauseder
6,874,291 B1 4/2005 Weber
6,880,307 B2 4/2005 Schwitte et al.
6,948,716 B2 9/2005 Drouin
7,021,019 B2 4/2006 Knauseder
7,040,068 B2 5/2006 Moriau et al.
7,051,486 B2 5/2006 Pervan
7,108,031 B1 9/2006 Secrest
7,121,058 B2 10/2006 Pålsson
7,152,383 B1 12/2006 Wilkinson et al.
7,188,456 B2 3/2007 Knauseder
7,219,392 B2 5/2007 Mullet et al.
7,251,916 B2 8/2007 Konzelmann et al.
7,257,926 B1 8/2007 Kirby
7,337,588 B1 3/2008 Moebus
7,377,081 B2 5/2008 Ruhdorfer
7,451,578 B2 11/2008 Hannig
7,454,875 B2 11/2008 Pervan et al.

(56) References Cited

U.S. PATENT DOCUMENTS 7,516,588 B2 4/2009 Pervan
7,517,427 B2 4/2009 Sjoberg et al.
7,533,500 B2 5/2009 Morton et al.
7,556,849 B2 7/2009 Thompson et al.
7,568,322 B2 8/2009 Pervan
7,584,583 B2 9/2009 Bergelin et al.
7,614,197 B2 11/2009 Nelson
7,617,651 B2 11/2009 Grafenauer
7,621,092 B2 * 11/2009 Groeke et al. ..... 52/586.1
7,634,884 B2 12/2009 Pervan
7,637,068 B2 12/2009 Pervan
7,644,553 B2 1/2010 Knauseder
7,654,055 B2 2/2010 Ricker
7,677,005 B2 3/2010 Pervan
7,716,889 B2 5/2010 Pervan
7,721,503 B2 5/2010 Pervan et al.
7,726,088 B2 6/2010 Muehlebach
7,757,452 B2 7/2010 Pervan
7,802,411 B2 9/2010 Pervan
7,806,624 B2 10/2010 McLean et al.
7,841,144 B2 11/2010 Pervan et al.
7,841,145 B2 11/2010 Pervan et al.
7,841,150 B2 11/2010 Pervan
7,856,789 B2 12/2010 Eisermann
7,861,482 B2 1/2011 Pervan et al.
7,866,110 B2 1/2011 Pervan
7,908,815 B2 3/2011 Pervan et al.
7,908,816 B2 3/2011 Grafenauer
7,930,862 B2 4/2011 Bergelin et al.
7,954,295 B2 6/2011 Pervan
7,980,039 B2 7/2011 Groeke
7,980,041 B2 7/2011 Pervan
8,006,458 B1 * 8/2011 Olofsson et al. ..... 52/582.1
8,033,074 B2 10/2011 Pervan
8,042,311 B2 10/2011 Pervan
8,061,104 B2 11/2011 Pervan
8,079,196 B2 12/2011 Pervan
8,112,967 B2 2/2012 Pervan et al.
8,171,692 B2 5/2012 Pervan
8,181,416 B2 5/2012 Pervan et al.
8,191,334 B2 6/2012 Braun
8,234,830 B2 8/2012 Pervan et al.
8,245,478 B2 8/2012 Bergelin
8,281,549 B2 10/2012 Du
8,302,367 B2 11/2012 Schulte
8,336,272 B2 12/2012 Prager et al.
8,341,914 B2 1/2013 Pervan et al.
8,341,915 B2 1/2013 Pervan et al.
8,353,140 B2 1/2013 Pervan et al.
8,359,805 B2 1/2013 Pervan et al.
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 8/2013 Boo et al.
8,511,031 B2 8/2013 Bergelin et al.
8,528,289 B2 9/2013 Pervan et al.
8,544,230 B2 10/2013 Pervan
8,544,234 B2 10/2013 Pervan et al.
8,572,922 B2 11/2013 Pervan
8,578,675 B2 11/2013 Palsson et al.
8,596,013 B2 12/2013 Boo
8,615,952 B2 12/2013 Engström
8,627,862 B2 1/2014 Pervan et al.
8,631,623 B2 1/2014 Engström
8,640,424 B2 2/2014 Pervan et al.
8,650,826 B2 2/2014 Pervan et al.
8,677,714 B2 3/2014 Pervan
8,689,512 B2 4/2014 Pervan
8,701,368 B2 4/2014 Vermeulen
8,707,650 B2 4/2014 Pervan
8,713,886 B2 5/2014 Boo et al.
8,733,065 B2 5/2014 Pervan
8,733,410 B2 5/2014 Pervan
8,763,341 B2 7/2014 Pervan
8,769,905 B2 7/2014 Pervan
8,776,473 B2 7/2014 Pervan et al.
8,844,236 B2 9/2014 Pervan et al.
8,857,126 B2 10/2014 Pervan et al.
8,887,468 B2 11/2014 Hakansson et al.
8,898,988 B2 12/2014 Pervan
8,925,274 B2 1/2015 Pervan et al.
8,938,929 B2 1/2015 Engström
8,959,866 B2 2/2015 Pervan
9,027,306 B2 5/2015 Pervan
9,051,738 B2 6/2015 Pervan et al.
9,068,360 B2 6/2015 Pervan
9,194,134 B2 11/2015 Nygren et al.
9,284,737 B2 3/2016 Pervan et al.
9,309,679 B2 4/2016 Pervan et al.
9,316,002 B2 4/2016 Boo
9,359,774 B2 6/2016 Pervan
9,366,036 B2 6/2016 Pervan
9,376,821 B2 6/2016 Pervan et al.
9,382,716 B2 7/2016 Pervan et al.
9,388,584 B2 7/2016 Pervan et al.
2001/0024707 A1 9/2001 Andersson et al.
2002/0031646 A1 3/2002 Chen et al.
2002/0069611 A1 6/2002 Leopolder
2002/0092263 A1 7/2002 Schulte
2002/0170258 A1 11/2002 Schwitte et al.
2002/0170259 A1 11/2002 Ferris
2002/0178674 A1 12/2002 Pervan
2002/0178680 A1 12/2002 Martensson
2002/0189190 A1 12/2002 Charmat et al.
2002/0194807 A1 12/2002 Nelson et al.
2003/0009971 A1 1/2003 Palmberg
2003/0024199 A1 2/2003 Pervan et al.
2003/0037504 A1 2/2003 Schwitte et al.
2003/0084636 A1 * 5/2003 Pervan ..... 52/592.1
2003/0094230 A1 5/2003 Sjoberg
2003/0101681 A1 6/2003 Tychsen
2003/0145549 A1 8/2003 Palsson et al.
2003/0180091 A1 9/2003 Stridsman
2003/0188504 A1 10/2003 Ralf
2003/0196405 A1 10/2003 Pervan
2004/0016196 A1 1/2004 Pervan
2004/0031227 A1 2/2004 Knauseder
2004/0049999 A1 3/2004 Krieger
2004/0060255 A1 4/2004 Knauseder
2004/0068954 A1 4/2004 Martensson
2004/0123548 A1 7/2004 Gimpel et al.
2004/0128934 A1 7/2004 Hecht
2004/0139676 A1 7/2004 Knauseder
2004/0139678 A1 7/2004 Pervan
2004/0159066 A1 8/2004 Thiers et al.
2004/0168392 A1 9/2004 Konzelmann et al.
2004/0177584 A1 9/2004 Pervan
2004/0182033 A1 9/2004 Wernersson
2004/0182036 A1 9/2004 Sjoberg et al.
2004/0200175 A1 10/2004 Weber
2004/0211143 A1 10/2004 Hannig
2004/0244325 A1 12/2004 Nelson
2004/0250492 A1 12/2004 Becker
2004/0261348 A1 12/2004 Vulin
2005/0003132 A1 1/2005 Blix et al.
2005/0028474 A1 2/2005 Kim
2005/0050827 A1 3/2005 Schitter
2005/0160694 A1 7/2005 Pervan
2005/0166514 A1 8/2005 Pervan
2005/0205161 A1 9/2005 Lewark
2005/0210810 A1 9/2005 Pervan
2005/0235593 A1 10/2005 Hecht
2005/0252130 A1 11/2005 Martensson
2005/0268570 A2 12/2005 Pervan
2006/0053724 A1 3/2006 Braun et al.
2006/0070333 A1 4/2006 Pervan
2006/0101769 A1 5/2006 Pervan
2006/0156670 A1 7/2006 Knauseder
2006/0174577 A1 8/2006 O'Neil
2006/0179754 A1 * 8/2006 Yang ..... 52/426
2006/0236642 A1 10/2006 Pervan
2006/0260254 A1 11/2006 Pervan et al.
2006/0272262 A1 12/2006 Pomberger

(56) References Cited

U.S. PATENT DOCUMENTS

2007/0006543 A1* 1/2007 Engstrom ..... 52/582.1
2007/0011981 A1 1/2007 Eiserman
2007/0028547 A1* 2/2007 Grafenauer et al. ..... 52/586.1
2007/0065293 A1 3/2007 Hannig
2007/0108679 A1 5/2007 Grothaus
2007/0151189 A1 7/2007 Yang et al.
2007/0175156 A1 8/2007 Pervan et al.
2007/0193178 A1 8/2007 Groeke et al.
2007/0209736 A1 9/2007 Deringor et al.
2007/0214741 A1 9/2007 Llorens Miravet
2008/0000182 A1 1/2008 Pervan
2008/0000185 A1 1/2008 Duernberger
2008/0000186 A1 1/2008 Pervan et al.
2008/0000187 A1 1/2008 Pervan et al.
2008/0005998 A1 1/2008 Pervan
2008/0010931 A1 1/2008 Pervan et al.
2008/0010937 A1* 1/2008 Pervan et al. ..... 52/588.1
2008/0028707 A1 2/2008 Pervan
2008/0034708 A1 2/2008 Pervan
2008/0041008 A1 2/2008 Pervan
2008/0053029 A1 3/2008 Ricker
2008/0066415 A1 3/2008 Pervan
2008/0104921 A1* 5/2008 Pervan et al. ..... 52/588.1
2008/0110125 A1 5/2008 Pervan
2008/0134607 A1 6/2008 Pervan
2008/0134613 A1* 6/2008 Pervan ..... 52/582.2
2008/0134614 A1 6/2008 Pervan
2008/0155930 A1 7/2008 Pervan et al.
2008/0216434 A1 9/2008 Pervan
2008/0216920 A1 9/2008 Pervan
2008/0236088 A1 10/2008 Hannig et al.
2008/0295432 A1 12/2008 Pervan et al.
2008/0302044 A1* 12/2008 Johansson ..... 52/403.1
2009/0019806 A1 1/2009 Muehlebach
2009/0064624 A1* 3/2009 Sokol ..... 52/589.1
2009/0100782 A1* 4/2009 Groeke et al. ..... 52/589.1
2009/0133353 A1 5/2009 Pervan et al.
2009/0151290 A1* 6/2009 Liu ..... 52/586.1
2009/0173032 A1 7/2009 Prager et al.
2009/0193741 A1 8/2009 Capelle
2009/0193748 A1* 8/2009 Boo et al. ..... 52/589.1
2009/0193753 A1 8/2009 Schitter
2009/0217615 A1 9/2009 Engstrom
2009/0241460 A1* 10/2009 Beaulieu ..... 52/586.2
2009/0308014 A1 12/2009 Muehlebach
2010/0043333 A1* 2/2010 Hannig ..... 52/582.2
2010/0083603 A1* 4/2010 Goodwin ..... 52/589.1
2010/0170189 A1 7/2010 Schulte
2010/0173122 A1 7/2010 Susnjara
2010/0281803 A1 11/2010 Cappelle
2010/0293879 A1 11/2010 Pervan et al.
2010/0300031 A1 12/2010 Pervan et al.
2010/0319290 A1 12/2010 Pervan
2010/0319291 A1* 12/2010 Pervan et al. ..... 52/588.1
2011/0016815 A1 1/2011 Yang
2011/0030303 A1 2/2011 Pervan et al.
2011/0041996 A1* 2/2011 Pervan ..... 156/265
2011/0047922 A1 3/2011 Fleming, III
2011/0088344 A1 4/2011 Pervan et al.
2011/0088345 A1 4/2011 Pervan
2011/0088346 A1 4/2011 Hannig
2011/0131916 A1 6/2011 Chen
2011/0154763 A1 6/2011 Bergelin et al.
2011/0167750 A1 7/2011 Pervan
2011/0167751 A1 7/2011 Engström
2011/0173914 A1 7/2011 Engström
2011/0197535 A1 8/2011 Baker et al.
2011/0225921 A1* 9/2011 Schulte ..... 52/588.1
2011/0225922 A1 9/2011 Pervan et al.
2011/0252733 A1 10/2011 Pervan
2011/0271632 A1 11/2011 Cappelle et al.
2011/0283650 A1 11/2011 Pervan et al.
2012/0017533 A1 1/2012 Pervan et al.
2012/0031029 A1 2/2012 Pervan et al.
2012/0036804 A1 2/2012 Pervan
2012/0042598 A1* 2/2012 Vermeulen et al. ..... 52/588.1
2012/0055112 A1 3/2012 Engström
2012/0124932 A1* 5/2012 Schulte et al. ..... 52/588.1
2012/0151865 A1 6/2012 Pervan et al.
2012/0174515 A1 7/2012 Pervan
2012/0174520 A1 7/2012 Pervan
2012/0174521 A1 7/2012 Schulte et al.
2012/0192521 A1* 8/2012 Schulte ..... 52/588.1
2012/0279161 A1* 11/2012 Hakansson et al. ..... 52/588.1
2012/0304590 A1 12/2012 Engström
2013/0008117 A1 1/2013 Pervan
2013/0008118 A1 1/2013 Baert et al.
2013/0014463 A1 1/2013 Pervan
2013/0019555 A1 1/2013 Pervan
2013/0042562 A1 2/2013 Pervan
2013/0042563 A1* 2/2013 Pervan et al. ..... 52/582.2
2013/0042564 A1 2/2013 Pervan et al.
2013/0042565 A1 2/2013 Pervan
2013/0047536 A1 2/2013 Pervan
2013/0081349 A1 4/2013 Pervan et al.
2013/0111837 A1* 5/2013 Devos et al. ..... 52/309.1
2013/0111845 A1 5/2013 Pervan
2013/0145708 A1 6/2013 Pervan
2013/0152500 A1 6/2013 Engström
2013/0160391 A1 6/2013 Pervan et al.
2013/0167467 A1* 7/2013 Vermeulen et al. ..... 52/588.1
2013/0232905 A2 9/2013 Pervan
2013/0239508 A1 9/2013 Pervan et al.
2013/0263454 A1 10/2013 Boo et al.
2013/0263547 A1 10/2013 Boo
2013/0283719 A1* 10/2013 Dohring et al. ..... 52/582.2
2013/0318906 A1 12/2013 Pervan et al.
2014/0007539 A1 1/2014 Pervan et al.
2014/0020324 A1 1/2014 Pervan
2014/0026513 A1 1/2014 Bishop
2014/0033634 A1 2/2014 Pervan
2014/0053497 A1 2/2014 Pervan et al.
2014/0059966 A1 3/2014 Boo
2014/0069043 A1 3/2014 Pervan
2014/0090335 A1 4/2014 Pervan et al.
2014/0109501 A1 4/2014 Pervan
2014/0109506 A1 4/2014 Pervan et al.
2014/0123586 A1 5/2014 Pervan et al.
2014/0130437 A1 5/2014 Cappelle
2014/0144096 A1 5/2014 Vermeulen et al.
2014/0150369 A1 6/2014 Hannig
2014/0186104 A1 7/2014 Hamberger
2014/0190112 A1 7/2014 Pervan
2014/0208677 A1 7/2014 Pervan et al.
2014/0223852 A1 8/2014 Pervan
2014/0237931 A1 8/2014 Pervan
2014/0250813 A1 9/2014 Nygren et al.
2014/0260060 A1 9/2014 Pervan et al.
2014/0290173 A1* 10/2014 Hamberger ..... E04F 13/0894 52/582.2
2014/0305065 A1 10/2014 Pervan
2014/0366476 A1 12/2014 Pervan
2014/0373480 A1 12/2014 Pervan et al.
2015/0000221 A1* 1/2015 Boo ..... 52/588.1
2015/0013260 A1 1/2015 Pervan
2015/0047284 A1* 2/2015 Cappelle et al. ..... 52/311.1
2015/0059281 A1 3/2015 Pervan
2015/0089896 A2 4/2015 Pervan et al.
2015/0121796 A1 5/2015 Pervan
2015/0167318 A1 6/2015 Pervan
2015/0176289 A1 6/2015 Hannig
2015/0176619 A1 6/2015 Baker
2015/0267419 A1 9/2015 Pervan
2015/0300029 A1 10/2015 Pervan
2016/0060879 A1 3/2016 Pervan
2016/0069088 A1 3/2016 Boo et al.
2016/0076260 A1 3/2016 Pervan et al.
2016/0090744 A1 3/2016 Pervan et al.
2016/0153200 A1 6/2016 Pervan
2016/0168866 A1 6/2016 Pervan et al.

(56) References Cited

U.S. PATENT DOCUMENTS

| | | | |
|---|---|---|---|
| 2016/0186426 | A1 | 6/2016 | Boo |
| 2016/0194884 | A1 | 7/2016 | Pervan et al. |
| 2016/0201336 | A1 | 7/2016 | Pervan |

FOREIGN PATENT DOCUMENTS

| | | | | |
|---|---|---|---|---|
| DE | 2 159 042 | | 6/1973 | |
| DE | 33 43 601 | A1 | 6/1985 | |
| DE | 33 43 601 | C2 | 6/1985 | |
| DE | 39 32 980 | A1 | 11/1991 | |
| DE | 42 15 273 | A1 | 11/1993 | |
| DE | 42 42 530 | A1 | 6/1994 | |
| DE | 196 01 322 | A | 5/1997 | |
| DE | 299 22 649 | U1 | 4/2000 | |
| DE | 200 01 788 | U1 | 6/2000 | |
| DE | 199 40 837 | A1 | 11/2000 | |
| DE | 199 58 225 | A1 | 6/2001 | |
| DE | 202 05 774 | U1 | 8/2002 | |
| DE | 203 20 799 | U1 | 4/2005 | |
| DE | 10 2004 055 951 | A1 | 7/2005 | |
| DE | 10 2004 001 363 | A1 | 8/2005 | |
| DE | 10 2005 002 297 | A1 | 8/2005 | |
| DE | 10 2004 054 368 | A1 | 5/2006 | |
| DE | 10 2005 024 366 | A1 | 11/2006 | |
| DE | 10 2006 024 184 | A1 | 11/2007 | |
| DE | 10 2006 037 614 | B3 | 12/2007 | |
| DE | 10 2006 057 491 | A1 | 6/2008 | |
| DE | 10 2007 018 309 | A1 | 8/2008 | |
| DE | 10 2007 016 533 | A1 | 10/2008 | |
| DE | 10 2007 032 885 | A1 | 1/2009 | |
| DE | 10 2007 035 648 | A1 | 1/2009 | |
| DE | 10 2007 049 792 | A1 | 2/2009 | |
| DE | 10 2009 048 050 | B3 | 1/2011 | |
| DE | WO 2013017574 | A1 * | 2/2013 | ..... E04F 13/0894 |
| EP | 0 013 852 | A1 | 8/1980 | |
| EP | 0 871 156 | A2 | 10/1998 | |
| EP | 0 974 713 | A1 | 1/2000 | |
| EP | 1 120 515 | A1 | 8/2001 | |
| EP | 1 146 182 | A2 | 10/2001 | |
| EP | 1 350 904 | A2 | 10/2003 | |
| EP | 1 350 904 | A3 | 10/2003 | |
| EP | 1 420 125 | A2 | 5/2004 | |
| EP | 1 437 457 | A2 | 7/2004 | |
| EP | 1 640 530 | A2 | 3/2006 | |
| EP | 1 650 375 | A1 | 4/2006 | |
| EP | 1 650 375 | A8 | 9/2006 | |
| EP | 1 980 683 | A2 | 10/2008 | |
| EP | 2 000 610 | A1 | 12/2008 | |
| EP | 2 017 403 | A2 | 1/2009 | |
| EP | 2 034 106 | A1 | 3/2009 | |
| EP | 2 333 195 | A1 | 6/2011 | |
| EP | 2 570 564 | A2 | 3/2013 | |
| EP | 2 333 195 | B1 | 7/2014 | |
| FR | 1.138.595 | | 6/1957 | |
| FR | 2 256 807 | | 8/1975 | |
| FR | 2 810 060 | A1 | 12/2001 | |
| GB | 240629 | | 10/1925 | |
| GB | 376352 | | 7/1932 | |
| GB | 1171337 | | 11/1969 | |
| GB | 2 051 916 | A | 1/1981 | |
| JP | 03-110258 | A | 5/1991 | |
| JP | 05-018028 | A | 1/1993 | |
| JP | 6-146553 | A | 5/1994 | |
| JP | 6-288017 | A | 10/1994 | |
| JP | 6-306961 | A | 11/1994 | |
| JP | 6-322848 | A | 11/1994 | |
| JP | 7-300979 | A | 11/1995 | |
| SE | 526 688 | C2 | 5/2005 | |
| SE | 529 076 | C2 | 4/2007 | |
| WO | WO 94/26999 | A1 | 11/1994 | |
| WO | WO 96/23942 | A1 | 8/1996 | |
| WO | WO 96/27721 | A1 | 9/1996 | |
| WO | WO 97/47834 | A1 | 12/1997 | |
| WO | WO 98/21428 | A1 | 5/1998 | |
| WO | WO 98/22677 | A1 | 5/1998 | |
| WO | WO 98/58142 | A1 | 12/1998 | |
| WO | WO 99/66151 | A1 | 12/1999 | |
| WO | WO 99/66152 | A1 | 12/1999 | |
| WO | WO 00/20705 | A1 | 4/2000 | |
| WO | WO 00/20706 | A1 | 4/2000 | |
| WO | WO 00/43281 | A2 | 7/2000 | |
| WO | WO 00/47841 | A1 | 8/2000 | |
| WO | WO 00/55067 | A1 | 9/2000 | |
| WO | WO 01/02669 | A1 | 1/2001 | |
| WO | WO 01/02670 | A1 | 1/2001 | |
| WO | WO 01/02671 | A1 | 1/2001 | |
| WO | WO 01/02672 | A1 | 1/2001 | |
| WO | WO 01/07729 | A1 | 2/2001 | |
| WO | WO 01/38657 | A1 | 5/2001 | |
| WO | WO 01/44669 | A2 | 6/2001 | |
| WO | WO 01/44669 | A3 | 6/2001 | |
| WO | WO 01/48331 | A1 | 7/2001 | |
| WO | WO 01/48332 | A1 | 7/2001 | |
| WO | WO 01/51732 | A1 | 7/2001 | |
| WO | WO 01/51733 | A1 | 7/2001 | |
| WO | WO 01/75247 | A1 | 10/2001 | |
| WO | WO 01/77461 | A1 | 10/2001 | |
| WO | WO 01/94721 | A1 | 12/2001 | |
| WO | WO 01/94721 | A8 | 12/2001 | |
| WO | WO 01/98604 | A1 | 12/2001 | |
| WO | WO 02/48127 | | 6/2002 | |
| WO | WO 02/055809 | A1 | 7/2002 | |
| WO | WO 02/055810 | A1 | 7/2002 | |
| WO | WO 02/081843 | A1 | 10/2002 | |
| WO | WO 02/103135 | A1 | 12/2002 | |
| WO | WO 03/012224 | A1 | 2/2003 | |
| WO | WO 03/016654 | A1 | 2/2003 | |
| WO | WO 03/025307 | A1 | 3/2003 | |
| WO | WO 03/038210 | A1 | 5/2003 | |
| WO | WO 03/044303 | A1 | 5/2003 | |
| WO | WO 03/069094 | A1 | 8/2003 | |
| WO | WO 03/074814 | A1 | 9/2003 | |
| WO | WO 03/083234 | A1 | 10/2003 | |
| WO | WO 03/087497 | A1 | 10/2003 | |
| WO | WO 03/089736 | A1 | 10/2003 | |
| WO | WO 2004/016877 | A1 | 2/2004 | |
| WO | WO 2004/020764 | A1 | 3/2004 | |
| WO | WO 2004/048716 | A1 | 6/2004 | |
| WO | WO 2004/050780 | A2 | 6/2004 | |
| WO | WO 2004/079128 | A1 | 9/2004 | |
| WO | WO 2004/079130 | A1 | 9/2004 | |
| WO | WO 2004/083557 | A1 | 9/2004 | |
| WO | WO 2004/085765 | A1 | 10/2004 | |
| WO | WO 2005/003488 | A1 | 1/2005 | |
| WO | WO 2005/003489 | A1 | 1/2005 | |
| WO | WO 2005/054599 | A1 | 6/2005 | |
| WO | WO 2006/043893 | A1 | 4/2006 | |
| WO | WO 2006/050928 | A1 | 5/2006 | |
| WO | WO 2006/104436 | A1 | 10/2006 | |
| WO | WO 2006/123988 | A1 | 11/2006 | |
| WO | WO 2006/125646 | A1 | 11/2006 | |
| WO | WO 2007/015669 | A2 | 2/2007 | |
| WO | WO 2007/019957 | A1 | 2/2007 | |
| WO | WO 2007/079845 | A1 | 7/2007 | |
| WO | WO 2007/089186 | A1 | 8/2007 | |
| WO | WO 2007/118352 | A1 | 10/2007 | |
| WO | WO 2007/141605 | A2 | 12/2007 | |
| WO | WO 2007/142589 | A1 | 12/2007 | |
| WO | WO 2008/004960 | A2 | 1/2008 | |
| WO | WO 2008/004960 | A8 | 1/2008 | |
| WO | WO 2008/017281 | A1 | 2/2008 | |
| WO | WO 2008/017301 | A2 | 2/2008 | |
| WO | WO 2008/017301 | A3 | 2/2008 | |
| WO | WO 2008/060232 | A1 | 5/2008 | |
| WO | WO 2008/068245 | A1 | 6/2008 | |
| WO | WO 2009/013590 | A2 | 1/2009 | |
| WO | WO 2009/066153 | A2 | 5/2009 | |
| WO | WO 2009/116926 | A1 | 9/2009 | |
| WO | WO 2010/006684 | A2 | 1/2010 | |
| WO | WO 2010/070472 | A2 | 6/2010 | |
| WO | WO 2010/070605 | A2 | 6/2010 | |
| WO | WO 2010/082171 | A2 | 7/2010 | |
| WO | WO 2010/087752 | A1 | 8/2010 | |
| WO | WO 2010/105732 | A1 | 9/2010 | |

(56) References Cited

FOREIGN PATENT DOCUMENTS

| | | | |
|---|---|---|---|
| WO | WO 2010/108980 | A1 | 9/2010 |
| WO | WO 2010/136171 | A1 | 12/2010 |
| WO | WO 2011/001326 | A2 | 1/2011 |
| WO | WO 2011/012104 | A2 | 2/2011 |
| WO | WO 2011/032540 | A2 | 3/2011 |
| WO | WO 2011/038709 | A1 | 4/2011 |
| WO | WO 2011/085788 | A1 | 7/2011 |
| WO | WO 2011/127981 | A1 | 10/2011 |
| WO | WO 2011/151758 | A2 | 12/2011 |
| WO | WO 2013/017574 | A1 | 2/2013 |
| WO | WO 2013/017575 | A1 | 2/2013 |
| WO | WO 2013/025164 | A1 | 2/2013 |
| WO | WO 2013/083629 | A1 | 6/2013 |
| WO | WO 2013/087190 | A1 | 6/2013 |

OTHER PUBLICATIONS

U.S. Appl. No. 14/701,959, Pervan, et al.
U.S. Appl. No. 14/646,567, Pervan.
U.S. Appl. No. 14/730,691, Pervan.
Välinge Innovation AB, Technical Disclosure entitled "Mechanical locking for floor panels with a flexible bristle tongue," IP.com No. IPCOM000145262D, Jan. 12, 2007, IP.com PriorArtDatabase, 57 pages.
Engstrand, Ola (Contact)/Välinge Innovation AB, Technical Disclosure entitled "VA-038 Mechanical Locking of Floor Panels With Vertical Folding," IP com No. IPCOM000179246D, Feb. 10, 2009, IP.com Prior Art Database, 59 pages.
Engstrand, Ola (Contact)/Välinge Innovation AB, Technical Disclosure entitled "VA043 5G Linear Slide Tongue," IP com No. IPCOM000179015D, Feb. 4, 2009, IP.com Prior Art Database, 126 pages.
Engstrand, Ola (Owner)/Välinge Innovation AB, Technical Disclosure entitled "VA043b PCT Mechanical Locking of Floor Panels," IP com No. IPCOM000189420D, Nov. 9, 2009, IP.com Prior Art Database, 62 pages.
Engstrand, Ola (Contact)/Välinge Innovation AB, Technical Disclosure entitled "VA055 Mechanical locking system for floor panels," IP com No. IPCOM000206454D, Apr. 27, 2011, IP.com Prior Art Database, 25 pages.
Engstrand, Ola (Contact)/Välinge Innovation AB, Technical Disclosure entitled "VA058 Rocker Tongue," IP com No. IPCOM000203832D, Feb. 4, 2011, IP.com Prior Art Database, 22 pages.
Pervan, Darko (Author)/Välinge Flooring Technology, Technical Disclosure entitled "VA066b Glued Tongue," IP com No. IPCOM000210865D, Sep. 13, 2011, IP.com Prior Art Database, 19 pages.
Pervan, Darko (Inventor)/Välinge Flooring Technology AB, Technical Disclosure entitled "VA067 Fold Slide Loc," IP com No. IPCOM000208542D, Jul. 12, 2011, IP.com Prior Art Database, 37 pages.
Pervan, Darko (Author)/Välinge Flooring Technology, Technical Disclosure entitled "VA068 Press Lock VFT," IP com No. IPCOM000208854D, Jul. 20, 2011, IP.com Prior Art Database, 25 pages.
Pervan, Darko (Author), Technical Disclosure entitled "VA069 Combi Tongue," IP com No. IPCOM000210866D, Sep. 13, 2011, IP.com Prior Art Database, 41 pages.
Pervan, Darko (Author), Technical Disclosure entitled "VA070 Strip Part," IP com No. IPCOM000210867D, Sep. 13, 2011, IP.com Prior Art Database, 43 pages.
Pervan, Darko (Author), Technical Disclosure entitled "VA071 Pull Lock," IP com No. IPCOM000210868D, Sep. 13, 2011, IP.com Prior Art Database, 22 pages.
Pervan, Darko (Author), Technical Disclosure entitled "VA073a Zip Loc," IP com No. IPCOM000210869D, Sep. 13, 2011, IP.com Prior Art Database, 36 pages.
LifeTips, "Laminate Flooring Tips," available at (http://flooring.lifetips.com/cat/61734/laminate-flooring-tips/index.html), 2000, 12 pages.
Pervan, Darko, U.S. Appl. No. 14/683,340 entitled "Mechanical Locking System for Floor Panels," filed in the U.S. Patent and Trademark Office Apr. 10, 2015.
Pervan, Darko, et al., U.S. Appl. No. 14/701,959 entitled "Mechanical Locking system for Floor Panels," filed in the U.S. Patent and Trademark Office May 1, 2015.
Pervan, Darko, U.S. Appl. No. 14/646,567 entitled "Mechanical Locking System for Floor Panels," filed in the U.S. Patent and Trademark Office May 21, 2015.
Pervan, Darko, U.S. Appl. No. 14/730,691 entitled "Mechanical Locking System for Panels and Method for Installing Same," filed in the U.S. Patent and Trademark Office Jun. 4, 2015.
U.S. Appl. No. 14/938,612, Pervan.
International Search Report mailed Aug. 13, 2015 in PCT/SE2015/050538, ISA/SE, Patent-och registreringsverket, Stockholm, SE, 4 pages.
Pervan, Darko, U.S. Appl. No. 14/938,612, entitled "Mechanical Locking System for Floor Panels," filed in the U.S. Patent and Trademark Office Nov. 11, 2015.
U.S. Appl. No. 14/951,976, Pervan.
U.S. Appl. No. 14/962,291, Pervan, et al.
Pervan, Darko, U.S. Appl. No. 14/951,976, entitled "Mechanical Locking System for Floor Panels," filed in the U.S. Patent and Trademark Office Nov. 25, 2015.
Pervan, Darko, et al., U.S. Appl. No. 14/962,291, entitled "Mechanical Locking System for Floor Panels," filed in the U.S. Patent and Trademark Office Dec. 8, 2015.
U.S. Appl. No. 15/048,252, Darko Pervan and Tony Pervan, filed Feb. 19, 2016.
U.S. Appl. No. 15/148,820, Darko Pervan, May 6, 2016.
Pervan, Darko, et al., U.S. Appl. No. 15/048,252, entitled "Mechanical Locking System for Floor Panels," filed in the U.S. Patent and Trademark Office Feb. 19, 2016.
Pervan, Darko, U.S. Appl. No. 15/148,820, entitled "Mechanical Locking System for Panels and Method of Installing Same," filed in the U.S. Patent and Trademark Office May 6, 2016.
U.S. Appl. No. 15/160,311, Darko Pervan, May 20, 2016.
U.S. Appl. No. 15/172,926, Darko Pervan and Agne Pålsson, Jun. 3, 2016.
U.S. Appl. No. 15/175,768, Darko Pervan and Tony Pervan, Jun. 7, 2016.
U.S. Appl. No. 15/217,023, Darko Pervan and Agne Pålsson, Jul. 22, 2016.
Pervan, Darko, U.S. Appl. No. 15/160,311, entitled "Mechanical Locking System for Floor Panels," filed in the U.S. Patent and Trademark Office May 20, 2016.
Pervan, Darko, et al., U.S. Appl. No. 15/172,926, entitled "Mechanical Locking of Floor Panels with a Flexible Bristle Tongue," filed in the U.S. Patent and Trademark Office on Jun. 3, 2016.
Pervan, Darko, et al., U.S. Appl. No. 15/175,768, entitled "Mechanical Locking System for Floor Panels," filed in the U.S. Patent and Trademark Office on Jun. 7, 2016.
Pervan, Darko, et al., U.S. Appl. No. 15/217,023, entitled "Mechanical Locking System for Floor Panels," filed in the U.S. Patent and Trademark Office on Jul. 22, 2016.

* cited by examiner

BUILDING PANEL WITH A MECHANICAL LOCKING SYSTEM

The present disclosure relates to a panels such as a building panels, floorboard, wall panels, ceiling panels, furniture components or the like, which is provided with a mechanical locking system.

TECHNICAL BACKGROUND

Building panels provided with a mechanical locking system comprising a displaceable and resilient tongue cooperating with a tongue groove for vertical locking is known and disclosed in, e.g., WO2006/043893, WO2007/015669 and WO2009/066153. The tongue is a separate part and is made of, e.g., plastic and inserted in a displacement groove at an edge of a panel. The tongue is pushed into the displacement groove during an assembling of the panels when the panels are moved vertically with respect to each other, and springs back into the tongue groove of an adjacent panel when the panels have reached a locked position.

Although most of the description relates to floor panel, the description of techniques and problems thereof is applicable also for other applications, such as panels for other purposes, for example wall panels, ceiling panels, furniture, etc.

A drawback with the known locking system is that the tongue may spring back with a lower force than desired.

The above description of various known aspects is the applicant's characterization of such, and is not an admission that any of the above description is considered as prior art.

SUMMARY

It is an object of certain embodiments of the present disclosure to provide an improvement over the above described techniques and known art. Particularly, the strength of the known locking system is improved by embodiments of the invention.

A further object of the disclosure is to provide panels with a locking system comprising a displaceable tongue that springs back with a greater force, without making the assembling of the panels more difficult.

At least some of these and other objects and advantages that will be apparent from the description have been achieved by a set of essentially identical panels provided with a mechanical locking system comprising a displaceable tongue, which is arranged in a displacement groove at a first edge of a first panel. The displacement groove is preferably open in a horizontal direction. The displaceable tongue is configured to cooperate with a first tongue groove at a second edge of an adjacent second panel, for locking the first and the second edge in a vertical direction. The displaceable tongue is of a longitudinal shape and resilient with a spring constant that varies in the longitudinal direction of the displaceable tongue. A middle section in the longitudinal direction of the displaceable tongue has a higher spring constant than a first edge section of the tongue.

The lower spring constant at the first edge section may facilitate assembling of the first and second panel at the first and the second edges while the higher spring constant at the middle section may provide an improved locking. The higher spring constant may also provide a higher click sound when the displaceable tongue enters into the tongue, groove. The higher click sound may be an indication to an assembler of the panels that the panels are properly assembled.

The displaceable tongue may function in a similar manner as a spring. When a spring is compressed, the force it exerts is essentially proportional to its change in length. The rate or spring constant of a spring is the change in the force it exerts, divided by the change in deflection of the spring. An extension or compression spring has units of force divided by distance, for example N/m. The displaceable tongue may be compressed in its width direction.

The displaceable tongue may also be provided or function in a similar manner as a torsion spring that has units of torque divided by angle, such as Nm/rad. The displaceable tongue may alternatively function as a combination of a spring and a torsion spring.

Depending on the design and required operating environment, any material may be used to construct a spring, as long as the material has the required combination of rigidity and elasticity.

The spring constant of the middle section may also be higher than a spring constant of a second edge section of the tongue.

An inner long edge of the tongue may comprise protrusions arranged in the displacement groove, wherein the protrusions are bendable. A first of the protrusions may be arranged at the middle section and a second of the protrusions may be arranged at the first edge section, wherein the bending resistance of the first of the protrusion is greater than the bending resistance of the second protrusion. A third of the protrusions may be arranged at the second edge section, wherein the bending resistance of the first of the protrusion may be greater than the bending resistance of the third protrusion. A thickness of the first protrusion may be greater than a thickness of the second protrusion. A thickness of the first protrusion may be greater than a thickness of the third protrusion.

The displaceable tongue may be provided with a symmetrical outer edge. An upper and a lower side of the outer edge are preferably both provided with a surface and a surface that may function as either a locking surface or a guiding surface. This embodiment may have the advantage that the displaceable tongue may be turned upside-down with the same guiding and locking function.

The mechanical locking system may comprise a first locking strip, at the first or the second edge, provided with a first locking element configured to cooperate with a first locking groove at the other of the first or second edge for locking the first and the second edge in a horizontal direction.

The panels may be rectangular and the mechanical locking system may comprise a second locking strip, at a third or fourth edge, provided with a second locking element configured to cooperate for horizontal locking with a locking groove at the other of the third of fourth edge of an adjacent third panel. The third or the fourth edge is preferably provided with a second tongue configured to cooperate for vertical locking with a second tongue groove at the other of the third of fourth edge of an adjacent third panel.

The mechanical locking system at the third and the fourth edge may be configured to be assembled by an angling motion.

The mechanical locking system at the first and the second edge may be configured to be assembled by a vertical motion.

The panels may be floorboards, wall panels, ceiling panels, a furniture component, or the like.

The core of the panels may be a wood-based core, preferably made of MDF, HDF, OSB, WPC, plywood or particleboard. The core may also be a polymer-based core comprising thermosetting plastic or thermoplastic, e.g., vinyl or PVC. The plastic core may comprise fillers.

The front face of the panels is preferably provided with a decorative layer and the back face is preferably provided with a balancing layer.

The edge of the panels, of which parts of the locking system, such as the first and the second locking strip, the first and the second locking element, the first and the second locking groove and the first and the second tongue groove, may be made, may comprise the core material.

BRIEF DESCRIPTION OF THE DRAWINGS

The present invention will by way of example be described in more detail with reference to the appended schematic drawings, which show several embodiments of the present invention.

DETAILED DESCRIPTION

Figure 1:
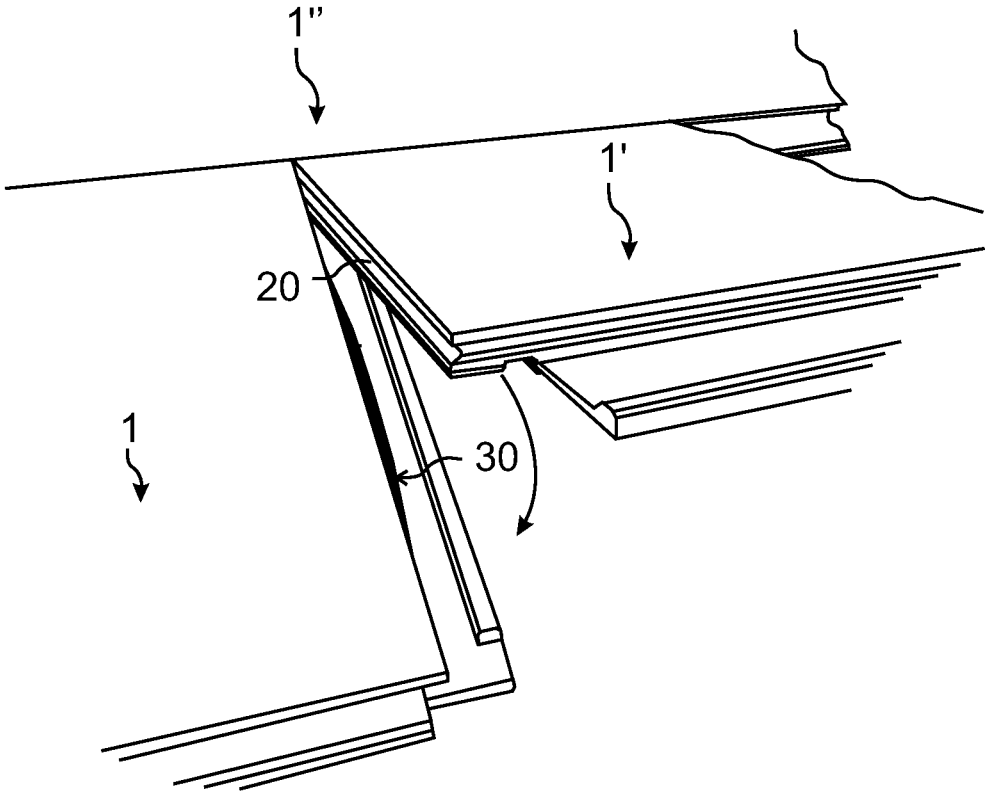
FIG. 1 shows assembling of floorboards provided with a locking system comprising a displaceable tongue.

An embodiment of a mechanical locking system for building panels, which comprises a displaceable tongue 30 cooperating with a first tongue groove 20 for vertical locking of a first edge of a first panel 1 with a second edge of a second panel 1', is shown in FIG. 1. The displaceable tongue 30 is a separate part and is made of e.g. a polymer material, and is inserted in a displacement groove 40 at the first edge of the first panel 1. The displaceable tongue 30 is pushed into the displacement groove 40 during a vertical assembling of the first and the second edges of the panels, and springs back into the first tongue groove 20 at the second edge of the second panel 1' when the panels have reached a locked position. The displaceable tongue 30 is of a longitudinal shape and has a spring constant that varies in the longitudinal direction of the displaceable tongue 30. A third and a fourth edge of the panels are provided with a locking system, which enables assembling to an adjacent panel 1" by an angling movement, to obtain a simultaneous assembling of the first and the second edges and the third and the fourth edges.

FIGS. 2A-2B and 3A-3B show in a locked position cross sections of different embodiments of the mechanical locking system provided at the first and second panels 1, 1'. A displaceable tongue 30 is arranged in a displacement groove 40 at the first edge of the first panel 1. The displaceable tongue 30 cooperates with a first tongue groove 20, which is formed at the second edge of the second panel 1', for vertical locking of the panels 1, 1'. A first locking strip 6 with a vertically protruding first locking element 8 is formed at the first edge of the first panel 1. The locking element 6 cooperates with a first locking groove 14, formed in the edge of the second panel 1', for horizontal locking of the panels 1, 1'.

Figure 2A:
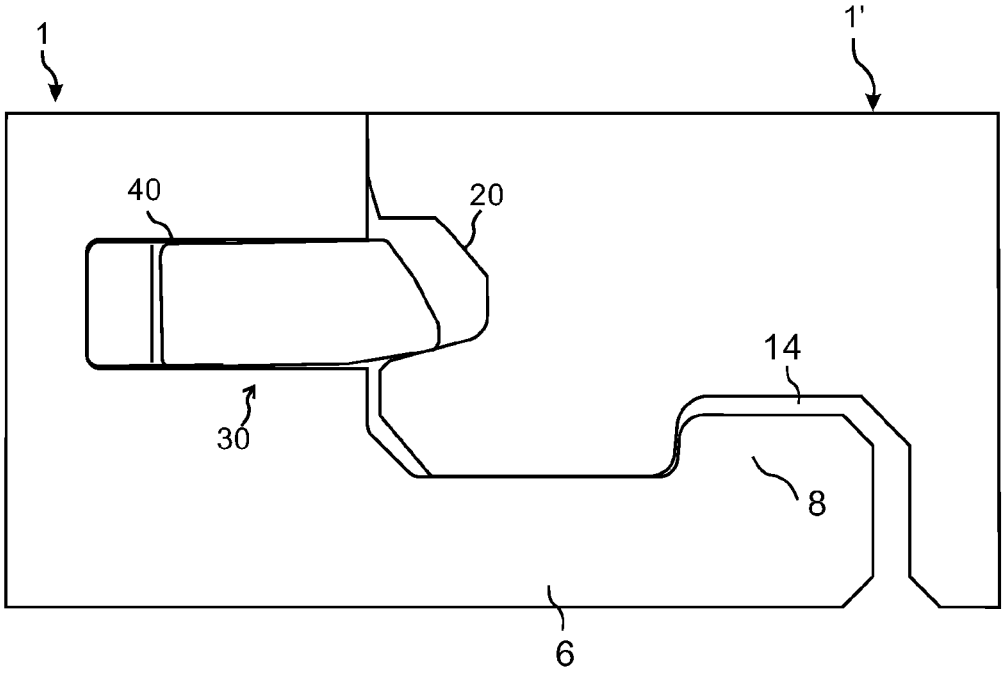
FIGS. 2A-2B show cross sections of embodiments of the locking system.
Figure 2B:
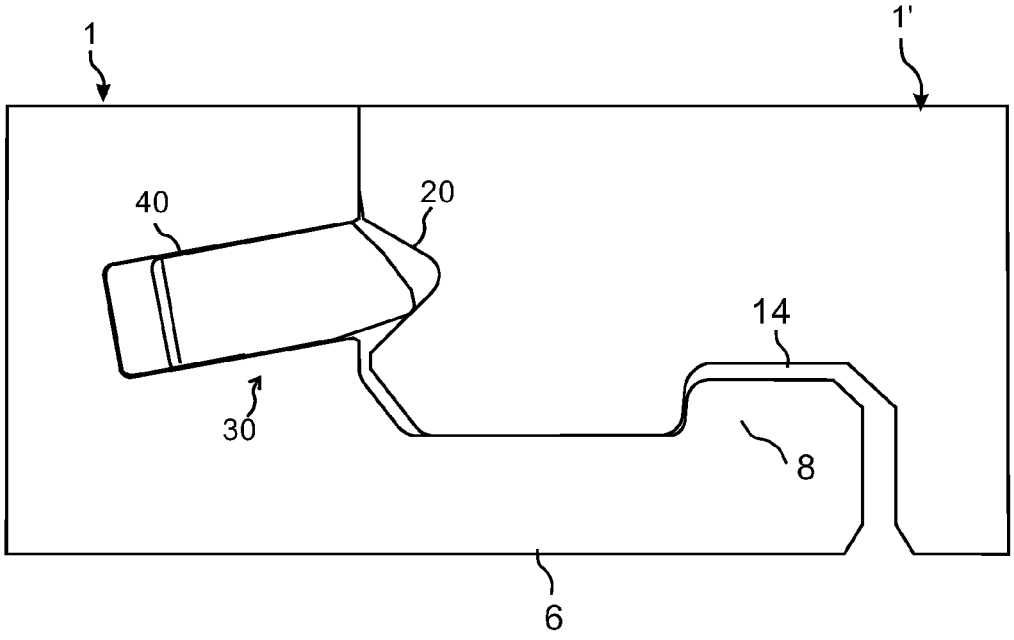
Figure 3A:
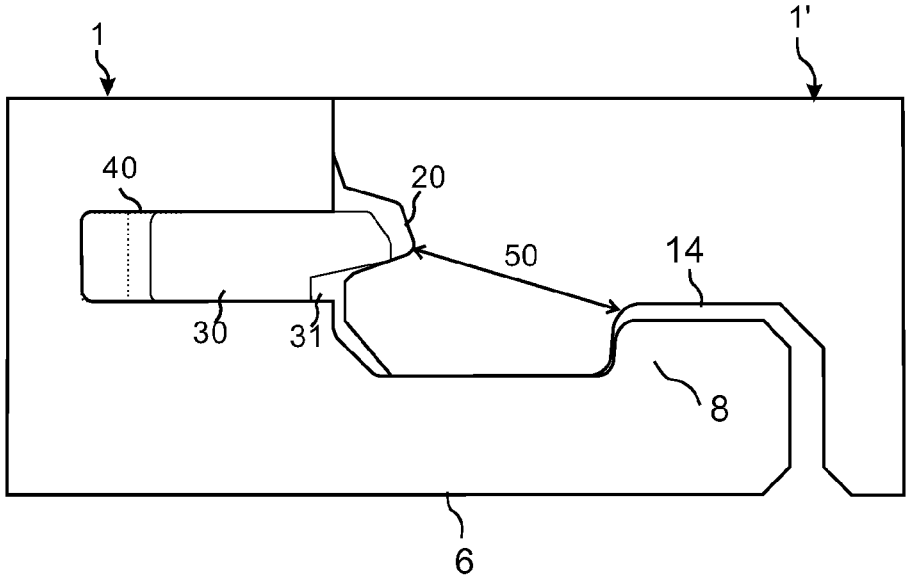
FIGS. 3A-3B show cross sections of embodiments of the locking system.
Figure 3B:
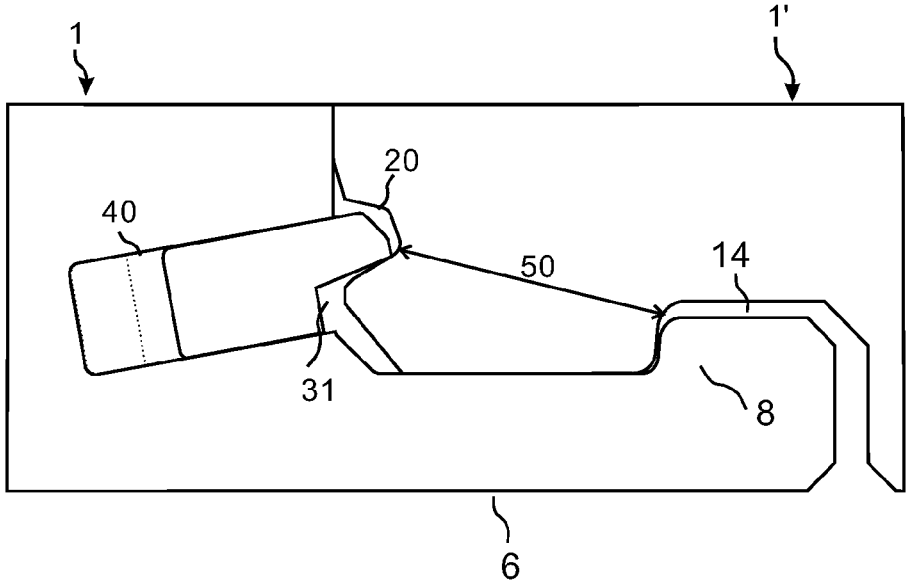

An embodiment of the displaceable tongue 30, which is shown in FIG. 3A-3B, is provided with a recess 31 at an outer tip of the displaceable tongue. The recess 31 makes it possible to have a smaller first tongue groove 20 and an increased distance 50 between the first tongue groove 20 and the locking groove 14. The increased distance may improve the strength of the mechanical locking system. Embodiments of the mechanical locking system may have a displacement groove 40 that extends in a direction essentially parallel to an upper surface of the panels, as is shown in FIG. 2A and FIG. 3A. The displacement groove may alternatively extend at an angle to the upper surface of the panels, as is shown in FIGS. 2B and 3B. The angled displacement groove 40 may have the advantage of the increased distance 50 between the first tongue groove 20 and the locking groove 14.

Figure 4A:
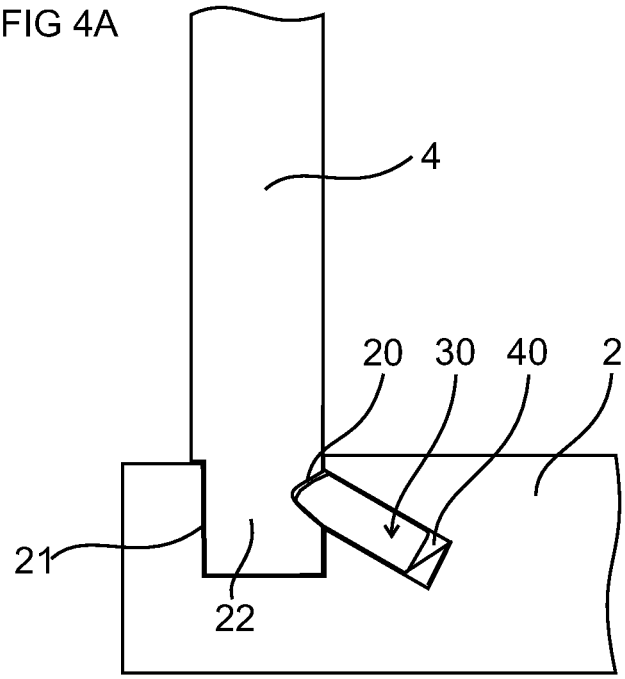
FIGS. 4A-4B show two perpendicular assembled panels provided with embodiments of the locking system.
Figure 4B:
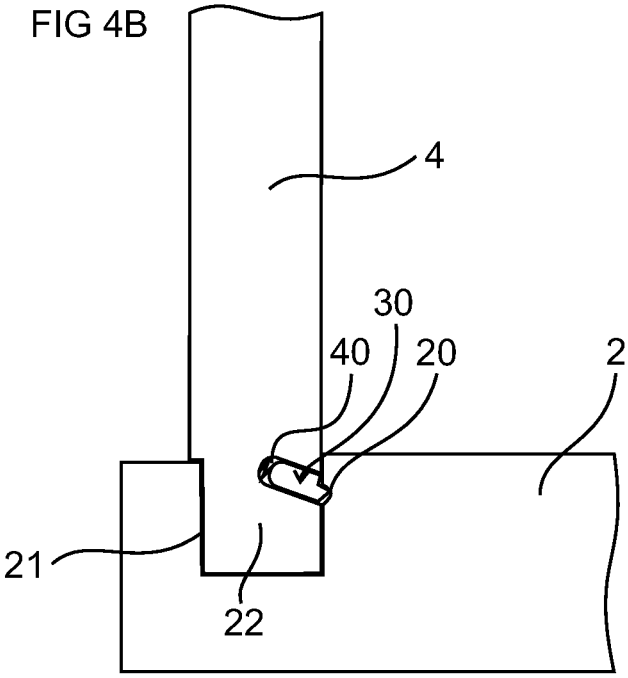

Embodiments of the mechanical locking system may be used to lock together a first panel 2 and a second panel 4 that are arranged essentially perpendicular to each other. An edge section 22 of the first panel 4 may be arranged in an edge section groove 21 of the second panel 2. FIG. 4A shows an embodiment with the displacement groove 40 arranged in the edge section groove 21 and the tongue groove 20 arranged at the edge section 22. FIG. 4B shows an embodiment with the displacement groove 40 arranged at the edge section 22 and the tongue groove 20 arranged in the edge section groove 21.

Figure 5A:
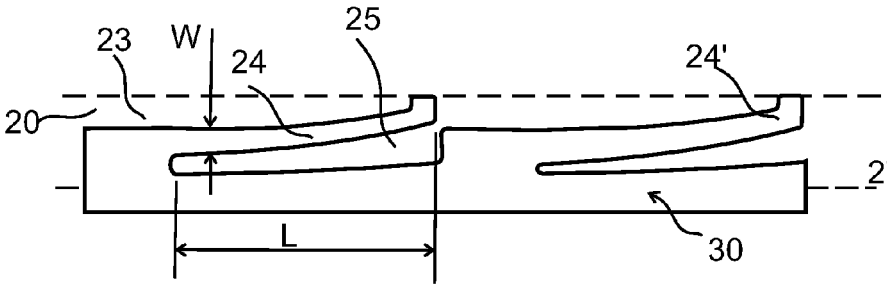
FIGS. 5A-5F show embodiments of the displaceable tongue.
Figure 5B:
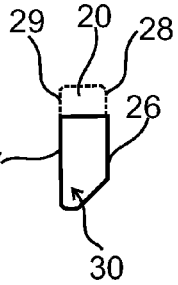

Preferred embodiments of the displaceable tongue 30 comprise protrusions 24 at a long edge of the displaceable tongue 30. The protrusions 24 are bendable and preferably arranged in the displacement groove 20. The protrusions 24 are configured to bend when the displaceable tongue 30 is pushed into the displacement groove 40 and to spring back to obtain the locked position. FIGS. 5A-5D show embodiments of the displaceable tongue 30 that is provided with a recess 25 at each of the protrusions. Each of the protrusions 24 is configured to be bent into a respective one of the recesses 25. FIG. 5B shows a cross section of the displaceable tongue 30 and the displacement groove 20 shown in FIG. 5A. The displaceable tongue 30 may comprise an upper and a lower displacement surface 26, 27 that is/are configured to cooperate with an upper and lower surface 28, 29, respectively, of the displacement groove 20. FIG. 5A shows a first protrusion 24 and a second protrusion 24' with different thicknesses. The thickness of the second protrusion 24' is larger than a thickness of the first protrusion 24 in order to obtain a larger spring constant of the second protrusion 24'. In addition, or alternatively, the length of the first protrusion may also be longer than the length of the second protrusion 24' in order to obtain a lower spring constant of the first protrusion 24. The first protrusion 24 is preferably arranged at a first edge section of the displaceable tongue 30 and the second protrusion 24' is preferably arranged at a middle section of the displaceable tongue 30. An advantage with a lower spring constant at an edge section may be that the force required for assembling is initially lower if panels are installed, e.g., as is shown in FIG. 1. An advantage with a high spring constant at the middle section may be that the spring force that forces the panels together is higher and a difference in level at the middle section of the first and the second edge, due to e.g. warped panels, may be levelled out. Differences in level at the edge sections of the first and second edge may be levelled out by the locking system at the third and forth edge.

Figure 5C:
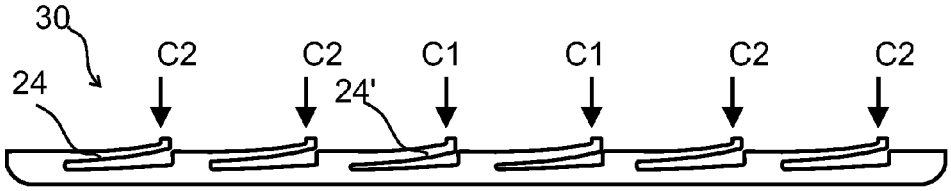
Figure 5D:
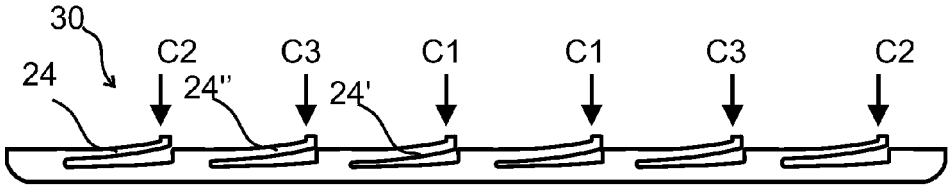

FIG. 5C shows an embodiment of the displaceable tongue 30 comprising protrusions with a first spring constant C1 at the middle section of the displaceable tongue 30 and protrusions 24 at the first and the second edge sections with a second spring constant C2. The first spring C1 constant is larger than the second spring constant C2. The first spring constant may be in the range of about 1.1 to about 5 times as large as the second spring constant, preferably about 1.5 to about 3 times as large as the second spring constant, and most preferably about twice as large as the second spring constant. FIG. 5D shows that the displaceable tongue may comprise protrusions with a spring constant C3 that is between the first and the second spring constant.

During assembly, the displaceable tongue may be displaced about 0.5 to about 3 mm, and the spring constant of the protrusion 24 at the first edge section of the tongue is preferably in the range of 0.1 N/mm to about 10 N/mm, and more preferably in the range of 1 N/mm to about 4 N/mm.

Figure 5E:
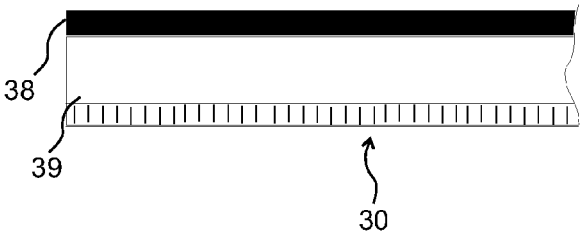
Figure 5F:
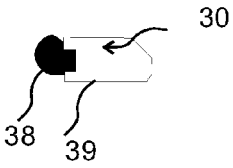

FIGS. 5E and 5F show that the displaceable tongue 30 may comprise an inner flexible part 38 and an outer stiffer part 39. The spring constant may be varied in the longitudinal direction of the displaceable tongue by having different thickness of the flexible part or by having different material of flexible part. FIG. 5E shows a cross section of the displaceable tongue shown in FIG. 5D.

Figure 6A:
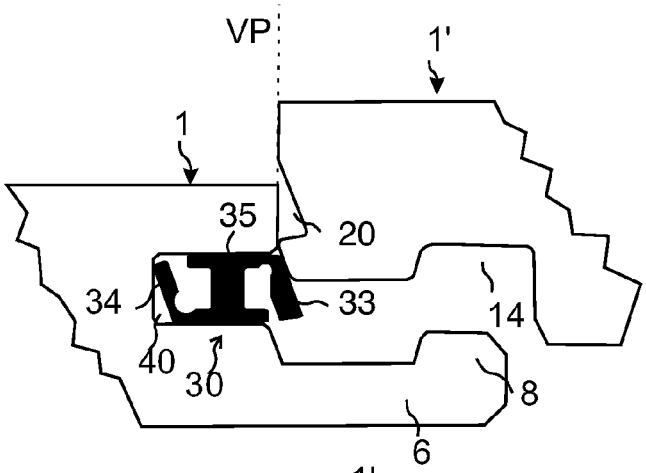
FIGS. 6A-6D show cross sections of embodiments of the locking system.
Figure 6B:
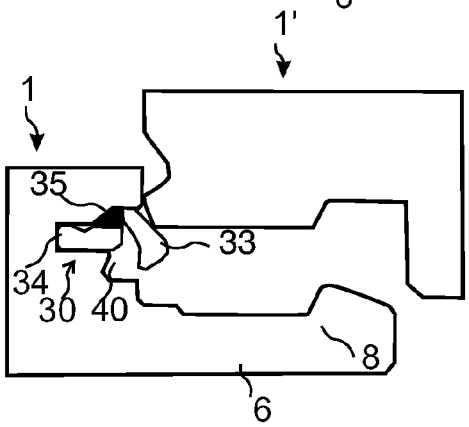

FIG. 6A-6B show embodiments of the displaceable tongue in a cross section during assembling of a first and a second panel. The embodiments of the displaceable tongue comprise three sections, an inner section 34, an outer section 33 and a middle section 35 connected to each other. The sections comprise preferably a polymer material. The outer and inner sections 33 and 34 are formed from a more rigid material than the middle section 35, which provides the major flexibility to the displaceable tongue 30. The middle section may be of a rubber like material and may also be used as a friction connection in order to prevent the flexible tongue from falling out of the displacement groove 40. The middle section 35 may function as a torsion spring. The outer section 33 preferably protrudes outside a vertical pane VP at the upper adjacent joint edges of the panels 1, 1'. The material and/or thickness of parts of the displaceable tongue may vary in the longitudinal direction of the displaceable tongue 30 to obtain the desired variation of the spring constant in the longitudinal direction of the displaceable tongue 30. The inner section 34 may comprise a fixing edge that may be located at an upper or a lower part.

Figure 6C:
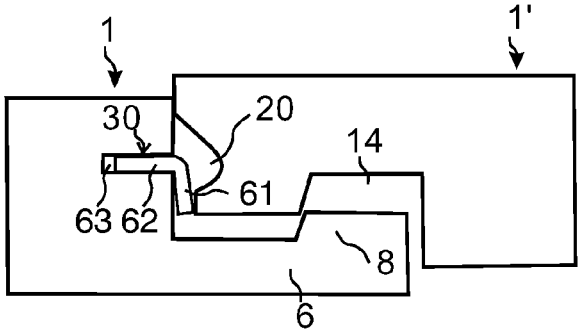

An embodiment of the displaceable tongue 30 may be of a V-shaped form as is shown in a cross section during assembling of a first and a second panel 1, 1' in FIG. 6C. An outer and first leg 61 of the displaceable tongue 30 may protrude outside an edge of the first panel 1. An inner and second leg 62 of the displaceable tongue 30 may be arranged in a fixation groove 63 at a first edge of the first panel 1. A second edge of the second panel is provided with a tongue groove 20. The first leg 61 is configured to cooperate with the tongue groove 20 for locking in a vertical direction. The thickness of the first leg 61 may vary in the longitudinal direction of the displaceable tongue 30 to obtain the desired variation of the spring constant in the longitudinal direction of the displaceable tongue 30. The first leg 61 may point downwards when the flexible tongue 30 is provided at an edge of a panel comprising a strip 6 and a locking element 8. The first leg 61 is pushed downward during assembling of the first and second panels 1, 1'.

Alternatively, the first leg 61 may point upwards when the flexible tongue 30 is provided at an edge of panel comprising a locking groove.

Figure 6D:
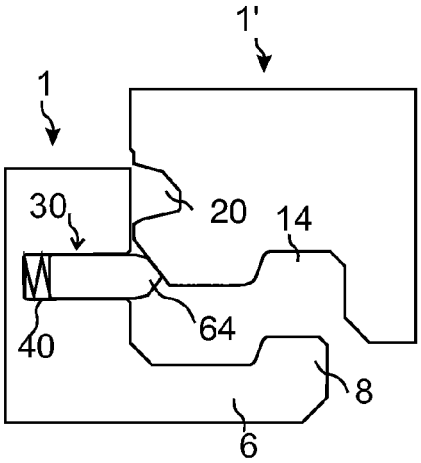

An embodiment of the displaceable tongue 30 with a symmetric outer edge 64 is shown if FIG. 6D. An upper and a lower side of the outer edge are both provided with a surface that may function as either a guiding surface and a locking surface. The guiding surface of the upper side of outer edge 64 cooperates with a guiding surface of the second edge of the second panel 1' during assembling of the first and the second panel 1, 1'. The locking surface of the upper side of outer edge 64 cooperates with a locking surface of the tongue groove 20 at the second edge of the second panel 1' in a locked position of the first and the second panel. The symmetric outer edge 64 may have the advantage that the displaceable tongue 30 has the same guiding and locking function also when the displaceable tongue is turned upside-down. An embodiment of the displaceable tongue with a first spring constant at the first edge section and a second spring constant and the second edge section may be turned upside down to change the position in the displacement groove of the first and the second edge section. The displaceable tongue is preferably positioned such that the edge section with lowest spring constant is the edge section with the earliest cooperation with the guiding surface of the second edge of the second panel 1' during assembling of the first and the second panel 1, 1'.

Although the present invention has been described and illustrated in detail, it is clearly understood that the same is by way of illustration and example only and is not to be taken by way of limitation, the spirit and scope of the present invention being limited only by the terms of the appended claims.

The invention claimed is:

1. A set of panels is provided with a mechanical locking system comprising a displaceable tongue, which displaceable tongue is arranged in a displacement groove at a first edge of a first of the panels, the displacement groove having an upper wall, a lower wall and a bottom wall between the upper wall and the lower wall, the displaceable tongue is configured to cooperate with a first tongue groove at a second edge of an adjacent second of the panels, for locking of the first edge and the second edge in a vertical direction, wherein the displaceable tongue is of a longitudinal shape and resilient, and comprises a plurality of protrusions arranged in the displacement groove, each protrusion in the displacement groove protruding from a main body of the displaceable tongue in a substantially horizontal direction, the horizontal direction being perpendicular to the vertical direction, toward the bottom wall, a spring constant of the protrusions varies in the longitudinal direction of the displaceable tongue, and the protrusions at a middle section in the longitudinal direction of the displaceable tongue have a higher spring constant than the protrusions at a first edge section of the displaceable tongue.

2. The set of panels as claimed in claim 1, wherein the displacement groove is horizontally open.

3. The set of panels as claimed in claim 1, wherein the spring constant of the protrusions at the middle section is higher than a spring constant of protrusions at a second edge section of the displaceable tongue.

4. The set of panels as claimed in claim 1, wherein the protrusions are bendable.

5. The set of panels as claimed in claim 4, wherein a first of the protrusions is arranged at the middle section and a second of the protrusions is arranged at the first edge section, wherein bending resistance of the first of the protrusions is greater than bending resistance of the second of the protrusions.

6. The set of panels as claimed in claim 5, wherein a third of the protrusions is arranged at the second edge section, wherein the bending resistance of the first of the protrusions is greater than bending resistance of the third protrusion.

7. The set of panels as claimed in claim 5, wherein a thickness of the first of the protrusions is greater than a thickness of the second of the protrusions.

8. The set of panels as claimed in claim 6, wherein a thickness of the first of the protrusions is greater than a thickness of the third of the protrusions.

9. The set of panels as claimed in claim 1, wherein the mechanical locking system comprises a first locking strip at the first edge of the first panel or at the second edge of the adjacent second panel, the first locking strip provided with a first locking element configured to cooperate for horizontal locking with a first locking groove at the other of the first edge or the second edge.

10. The set of panels as claimed in claim 9, wherein the panels are rectangular and the mechanical locking system comprises a second locking strip at a third edge or a fourth edge of an adjacent third panel, the second locking strip provided with a second locking element configured to cooperate for horizontal locking with a second locking groove at the other of the third edge or the fourth edge of the adjacent third panel.

11. The set of panels as claimed in claim 10, wherein the mechanical locking system at the third edge and the fourth edge of the panels is configured to be assembled by an angling motion.

12. The set of panels as claimed in claim 1, wherein the mechanical locking system at the first edge and the second edge of the panels is configured to be assembled by a vertical motion.

13. The set of panels as claimed in claim 1, wherein the panels are building panels.

14. The set of panels as claimed in claim 1, wherein the spring constant of the protrusions at the middle section is 1.5 to 3 times higher than the spring constant of the protrusions at the first edge section.

15. The set of panels as claimed in claim 1, wherein the spring constant of the protrusions at the first edge section is in the range of about 0.1 to about 10 N/mm.

16. The set of panels as claimed in claim 1, wherein the spring constant of the protrusions at the first edge section is in the range of about 1 to about 4 N/mm.

17. The set of panels as claimed in claim 15, wherein the spring constant of the protrusions at the middle section is 1.5 to 3 times higher than the spring constant of the protrusions at the first edge section.

18. The set of panels as claimed in claim 16, wherein the spring constant of the protrusions at the middle section is 1.5 to 3 times higher than the spring constant of the protrusions at the first edge section.

19. The set of panels as claimed in claim 1, wherein the protrusions are spaced from each other in a direction along the longitudinal direction of the displaceable tongue.

* * * * *